US007946322B2

(12) United States Patent
Valvano et al.

(10) Patent No.: US 7,946,322 B2
(45) Date of Patent: May 24, 2011

(54) INTERCHANGEABLE BAG AND COVER SYSTEM

(75) Inventors: Michael Valvano, San Francisco, CA (US); Jeffrey Levis, Thornton, CO (US); Gregory Fritsch, Paradise, CA (US); Rory W. Fuerst, Atherton, CA (US)

(73) Assignee: Overland Equipment, Inc., Chico, CA (US)

( * ) Notice: Subject to any disclaimer, the term of this patent is extended or adjusted under 35 U.S.C. 154(b) by 45 days.

(21) Appl. No.: 12/426,877

(22) Filed: Apr. 20, 2009
(Under 37 CFR 1.47)

(65) Prior Publication Data

US 2010/0096051 A1 Apr. 22, 2010

Related U.S. Application Data

(63) Continuation of application No. 12/205,737, filed on Sep. 5, 2008, now abandoned.

(60) Provisional application No. 60/970,183, filed on Sep. 5, 2007.

(51) Int. Cl.
*A45C 13/08* (2006.01)

(52) U.S. Cl. ..... 150/105; 150/119

(58) Field of Classification Search ..... 150/103–105, 150/119
See application file for complete search history.

(56) References Cited

U.S. PATENT DOCUMENTS

| | | | | | |
|---|---|---|---|---|---|
| 1,747,801 | A | * | 2/1930 | Topal | 150/104 |
| 5,172,838 | A | * | 12/1992 | Rowell et al. | 224/680 |
| D369,021 | S | * | 4/1996 | Kliot | D3/217 |
| 5,503,204 | A | * | 4/1996 | Byers et al. | 150/105 |
| D370,341 | S | * | 6/1996 | Azar et al. | D3/233 |
| D374,346 | S | * | 10/1996 | Giovannella | D3/243 |
| 5,725,039 | A | * | 3/1998 | Macinai et al. | 150/104 |
| 5,857,600 | A | * | 1/1999 | Akutsu | 224/240 |
| 6,318,528 | B1 | * | 11/2001 | Blanckaert | 190/119 |
| 6,446,688 | B1 | * | 9/2002 | Sutton | 150/105 |
| 2006/0188179 | A1 | * | 8/2006 | Schlipper | 383/34 |
| 2009/0188592 | A1 | * | 7/2009 | Connacher et al. | 150/105 |

FOREIGN PATENT DOCUMENTS

JP 2000-116423 * 4/2000

* cited by examiner

*Primary Examiner* — Tri M Mai
(74) *Attorney, Agent, or Firm* — Alleman Hall McCoy Russell & Tuttle LLP

(57) ABSTRACT

An interchangeable bag and cover system is provided that comprises a body with a first connection portion. A first securing mechanism is coupled to the body. A plurality of covers are interchangeably connectable to the body. Each cover has a second connection portion releasably attachable to the first connection portion of the body, wherein the cover is moveable relative to the body between open position and closed positions. Each cover has a free end portion positionable adjacent to the body when the cover is in the close position. Each cover has a second securing mechanism configured to releasably engage the first securing mechanism to retain the cover in the closed position.

23 Claims, 8 Drawing Sheets

INTERCHANGEABLE BAG AND COVER SYSTEM

CROSS-REFERENCE TO RELATED APPLICATIONS

This application is a continuation of U.S. application Ser. No. 12/205,737, entitled "INTERCHANGEABLE BAG AND COVER SYSTEM," filed Sep. 5, 2008, which claims benefit of U.S. Provisional Application No. 60/970,183, entitled "INTERCHANGEABLE BAG AND COVER SYSTEM," filed Sep. 5, 2007, each of which is hereby incorporated by reference in its entirety.

TECHNICAL FIELD

The present invention is directed to bags and more particularly to bags with removable and interchangeable covers.

OVERVIEW

Bags, such as messenger bags, backpacks, purses, briefcases, etc., are manufactured in very diverse sizes, shapes, colors, designs, and with a variety of materials. However, conventional bags are typically produced as complete units with defined aesthetic appearances and utility features. The interchangeable bag and cover system in accordance with at least one aspect of the present invention provides fellable vessels and multiple removable covers that can be mixed and matched to form a variety of interchangeable bag and cover combinations having varying appearances and utility features.

SUMMARY

An interchangeable bag and cover system in accordance with aspects of the present invention overcome problems experienced in the prior art and provide other benefits. In one embodiment, a convertible bag system is provided that comprises a body having side portions that define an interior area having an opening. The body having a cover-connection portion. A first securing mechanism is coupled to the body. A plurality of covers are interchangeably connectable to the body. Each cover has a body-connection portion releasably attachable to the cover-connection portion of the body, wherein the cover is moveable relative to the body between open position and closed positions. Each cover has a free end portion positionable adjacent to the body when the cover is in the close position. Each cover has a second securing mechanism configured to releasably engage the first securing mechanism to retain the cover in the closed position.

In accordance with another embodiment, an interchangeable bag and cover system is provided that comprises a plurality of bodies, each body having a plurality of panels that define a closed end, an open end, and a cavity configured to contain selected items inserted therein through the opening. Each body has a first connector. A plurality of covers are provide, wherein each cover is interchangeably and releasably connectable to any of the bodies. Each cover, when connected to a selected body, is moveable relative to the selected body between open and closed positions. Each cover extends across the open end of the body when in the closed position, and the cover is positioned to expose the open end when in the open position. Each cover has a second connector releasably engageable with any of the first connectors of any of the bodies, so that any of the covers can be interchangeably used with any of the bodies.

In accordance with another embodiment, a convertible bag and cover assembly is provided that comprises a body having a closed end, an open end, and a cavity configured to contain selected items inserted therein through the opening. The body has a first connector. A cover is releasably connected to the body. The cover, when connected to the body, is moveable relative to the body between open and closed positions. The cover is configured to extend across the open end when in the closed position and to expose the open end when in the open position. The cover has a second connector releasably engageable with the first connector of the body, so that the cover can be removed and replaced by another cover having substantially the same construction as said cover.

DETAILED DESCRIPTION

The present disclosure describes bag systems including systems for providing carrying bags having interchangeable vessels and covers in accordance with an embodiment of the present invention. Several specific details of aspects of the invention are set forth in the following description and in FIGS. 1-11 to provide a thorough understanding of certain embodiments of the invention. One skilled in the art, however, will understand that the present invention may have additional embodiments, and that other embodiments of the invention may be practiced without several of the specific features described below.

Figure 1:
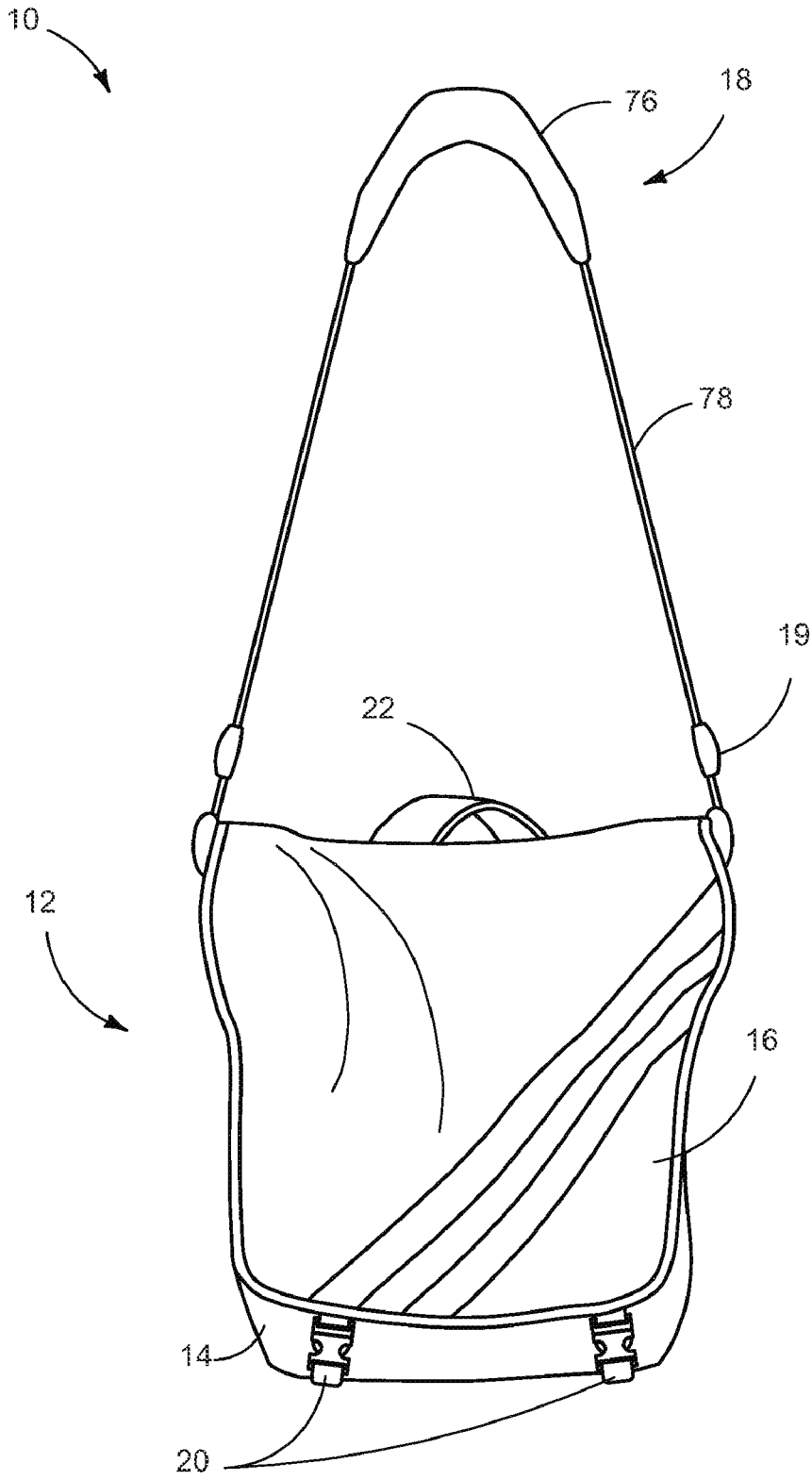
FIG. 1 is a front view of a convertible bag system in accordance with an embodiment of the present invention.
Figure 2:
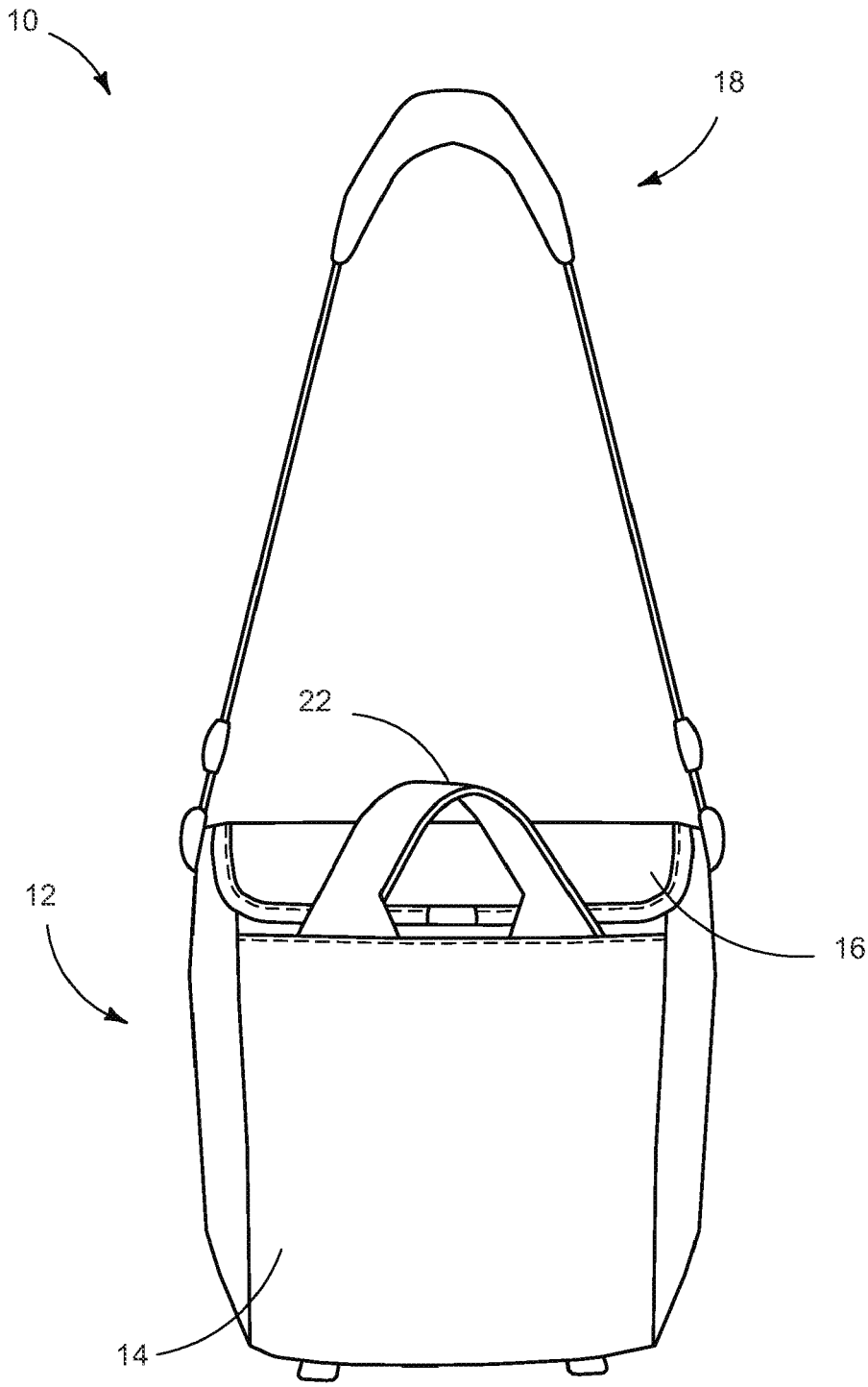
FIG. 2 is a back view of the convertible bag system of FIG. 1.

FIG. 1 is a front view and FIG. 2 is back view of a convertible bag system 10 in accordance with an embodiment of the present invention. The convertible bag system 10 includes an interchangeable bag and cover assembly 12 having a body 14 that defines a vessel, and cover 16 detachably connected to the body. The convertible bag system 10 can also be provided with an integrated strap system 18 (as shown in FIG. 1). The integrated strap system 18 can be configured to be removeably attached and/or adjusted, and can include a length adjustment mechanism 19. Additionally, the interchangeable bag and cover assembly 12 can also include a plurality of mating-type closures 20 for securing the cover 16 in a closed position relative to the body 14 (explained in more detail below). The assembly 12 may also be provided with a carrying handle 22.

Figure 3:
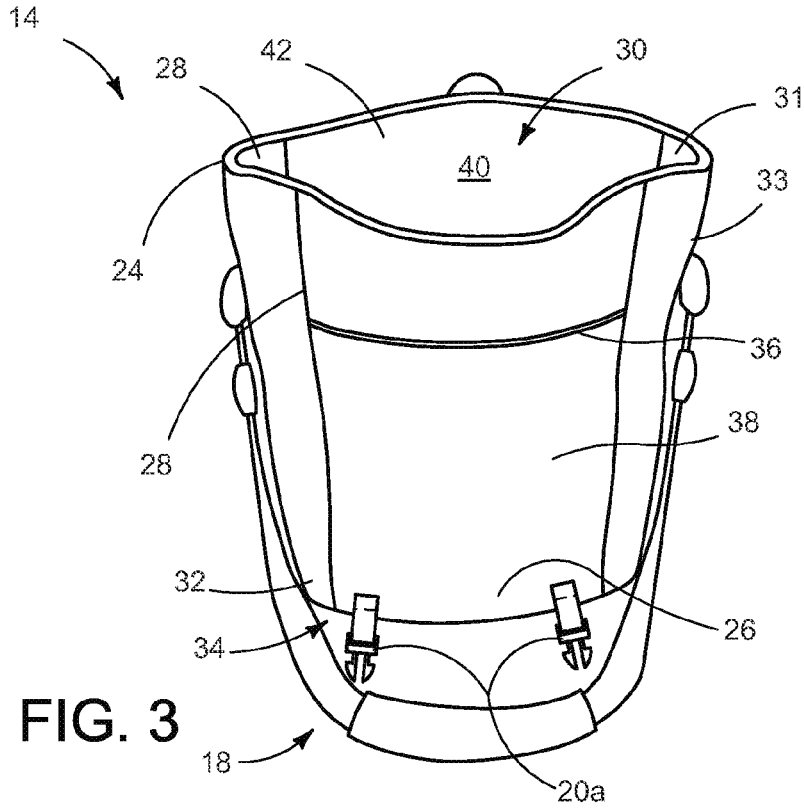
FIG. 3 is a front perspective view of a body in accordance with an embodiment of the present invention.

FIG. 3 illustrates a front perspective view of the body 14 in accordance with one embodiment of the invention. The body 14 of the illustrated embodiment includes an open end 24 and a closed end 26 and a plurality of panels 28. The closed end 26 and panels 28 create a vessel or cavity 30 which may be filled by depositing items through a mouth 31 defined by the open end 24. In one embodiment, the closed end 26 can be a separate panel that is attached to one or more side panels 28 to form the cavity 30. In another embodiment, the plurality of panels 28 can be integrally connected or can be stitched, glued, or otherwise secured together at lower edges 32 to form the closed end 26.

As shown, the body 14 can include strap attachment sites 33 for attaching the integrated strap system 18. The strap attachment sites 33 can be configured to securely connect to the strap system 18. In one embodiment, the strap attachment sites 33 can include one or more strap attachment mechanisms (not shown) for releaseably attaching the strap system 18 to the body 14. In another embodiment, the body 14 can include one or more attachment mechanisms that engage one or more portions of the strap system 18. In the illustrated embodiment, the body 14 includes first closure attachment sites 34 for integrating a first portion 20*a* of the mating-type closure 20 (e.g., the male or female portion of a buckle, a magnet, a snap, a button, a hook or loop strip, etc.). The other portion of the mating-type closure is attached to the strap system.

The body 14 can also be provided with one or more pockets 36 or other compartments. For example, the body 14 can have pockets 36 integrated on an exterior surface 38 and/or integrated on an interior surface 40 of the panels 28. These pockets 36 can be provided as non-closing pockets or can include a flap or closure mechanism, such as with a zipper, buttons, corresponding hook and loop strips, elastic band, etc., for securing items.

In another embodiment, the cavity 30 of the body 14 may be provided with one or more main internal compartments for storing and transporting items. Internal panels (not shown) may be provided to divide the cavity 30 into a plurality of compartments for separating and/or organizing items within the cavity 30. Padding 42 may also be provided within the cavity 30 for protecting delicate or fragile items, such as electronic equipment (e.g. laptop computer, camera, music devices, PDA devices, cell phones, etc.), or for additional comfort while transporting the convertible bag system 10 proximal to a user's body. The padding 42 can be integrated within the panels 28 and/or interior panels in some embodiments. Furthermore, the body 14 can be configured to have removable or replaceable interior panels and/or pockets, such that a user can reconfigure, add, or remove these sub-compartment features. Those of ordinary skill in the art will recognize that the size and shape of the pockets and/or panels 28 and the overall size and shape of the body 14 or portions of the body may vary according to preference for the size of the bag, the accommodating capacity, and/or configuration of the cavity 30.

Figure 4:
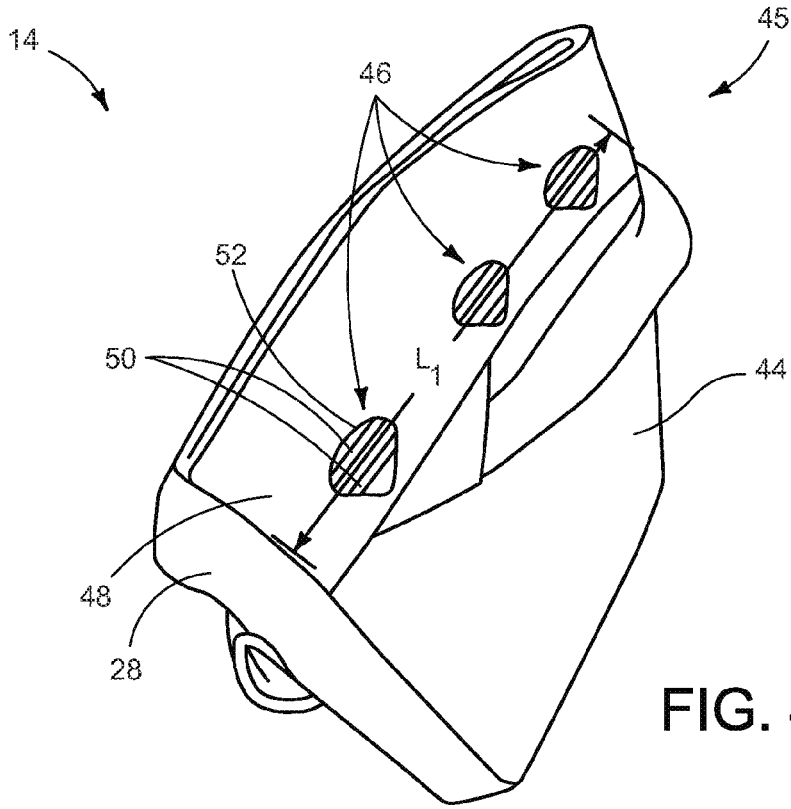
FIG. 4 is an isometric view of the body of FIG. 3 illustrating a back panel with cover attachment portions in accordance with an embodiment of the present invention.

FIG. 4 is an isometric view of a panel, such as a back panel 44 of the body 14 of FIG. 3. In accordance with an embodiment of the present invention, the body 14 can include an attachment system 45 having one or more attachment portions 46 integrated on a region, such as the upper region 48 of the back panel 44. The attachment system 45 allows a variety of interchangeable covers 16 to be independently attached and removed from the body 14 (described in more detail below). As illustrated, the attachment portions 46 can be one or more rods 50 integrated with the back panel 44 of the body 14. The rod 50 of the illustrated embodiment is a substantially rigid or stiff cylindrical rod. In other embodiments, the rod can be a substantially rigid or stiff bar or other non-cylindrical structure to which the cover 16 is removably attached. In one embodiment, the back panel 44 can include a plurality of access portals 52 through the exterior surface 38 of the back panel to expose the attachment portions 46. In other embodiments, the attachment system 45 can be integrated with the body 14 in an alternate region or panel 28.

In some embodiments, a single rod 50 can be integrated with the body 14, such that the rod spans a length $L_1$ that encompasses the plurality of access portals 52. In other embodiments, the attachment portions 46 may comprise a plurality of rods 50 that are independently integrated into the body 14 and exposed to the exterior surface 38 of the back panel 44 by way of the access portals 52. In this embodiment, the rods 50 can move independently with respect to adjacent rods 50 and provide additional freedom of movement and pliability to the rod integration region (e.g. the upper region 48 of the back panel 44). One of ordinary skill in the art will recognize that the rods 50 can be made of metal, plastic, or other sturdy and durable material. Additionally, the rods 50 may have constant or variable diameters or thicknesses appropriate for the selected size and durability requirements of the bag system 10.

Figure 5:
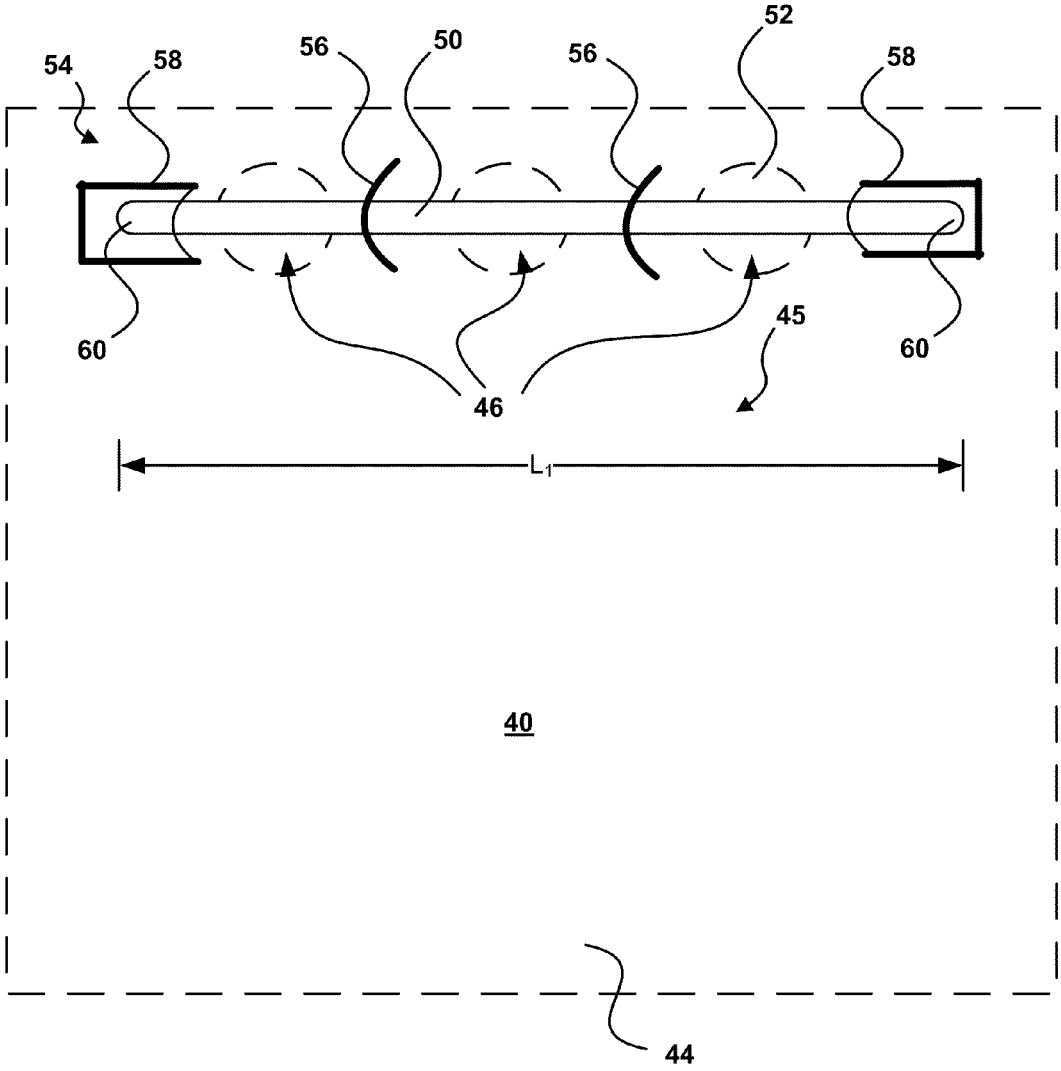
FIG. 5 is an enlarged view of a rod mounting system in accordance with an embodiment of the present invention.

FIG. 5 illustrates one embodiment of a rod mounting system 54 in accordance with the present invention. As shown, the back panel 44 can include supporting loops 56 and/or sleeved receiving caps 58 for receiving the ends 60 of the rod 50. The supporting loops 56 and receiving caps 58 can be securely fixed (e.g., sewn, glued, or otherwise attached) to the body 14 on the exterior 38 or interior 40 (as shown) of the back panel 44 of the body 14. As illustrated, supporting loops 56 and receiving caps 58 can be spaced alternately with access portals 52 to provide unobstructed attachment portions 46 from the exterior 38 of the back panel 44. In another embodiment, the supporting loops 56 and receiving caps 58 can be attached to a panel 28 other than the back panel 44. In other embodiments, the supporting loops 56 and receiving caps 58 can be attached with an adhesive, tape, corresponding hook and loop strips, zippers, snaps, etc. One of ordinary skill in the art will recognize other mechanisms that can be used to securely mount rods 50 or otherwise integrate rods 50 with the body 14. Furthermore, one of ordinary skill in the art will appreciate that a plurality of receiving caps 58 and/or supporting loops 56 can be included to securely mount a plurality of rods 50.

Figure 6:
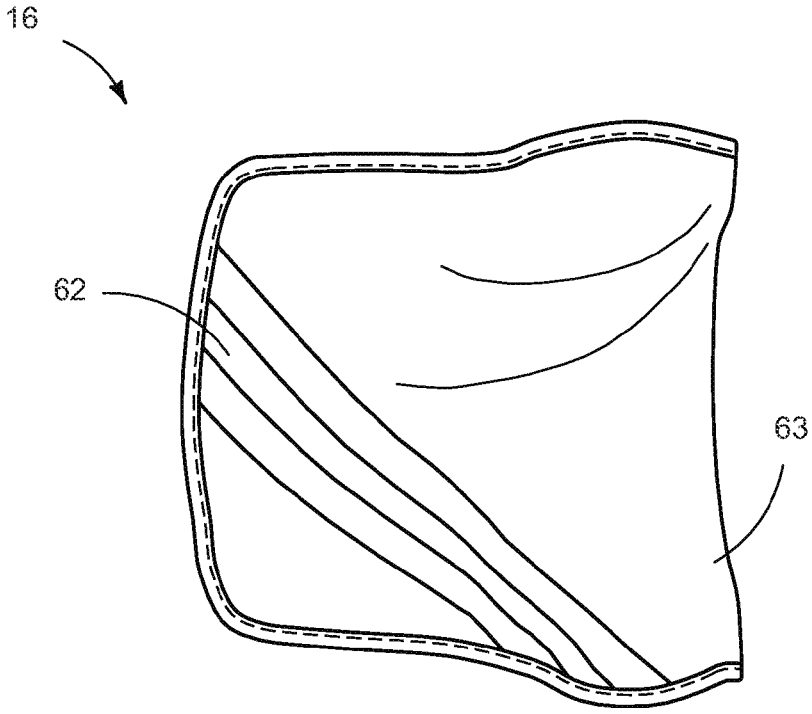
FIG. 6 is a top view of a cover of a convertible bag system in accordance with an embodiment of the present invention.
Figure 7:
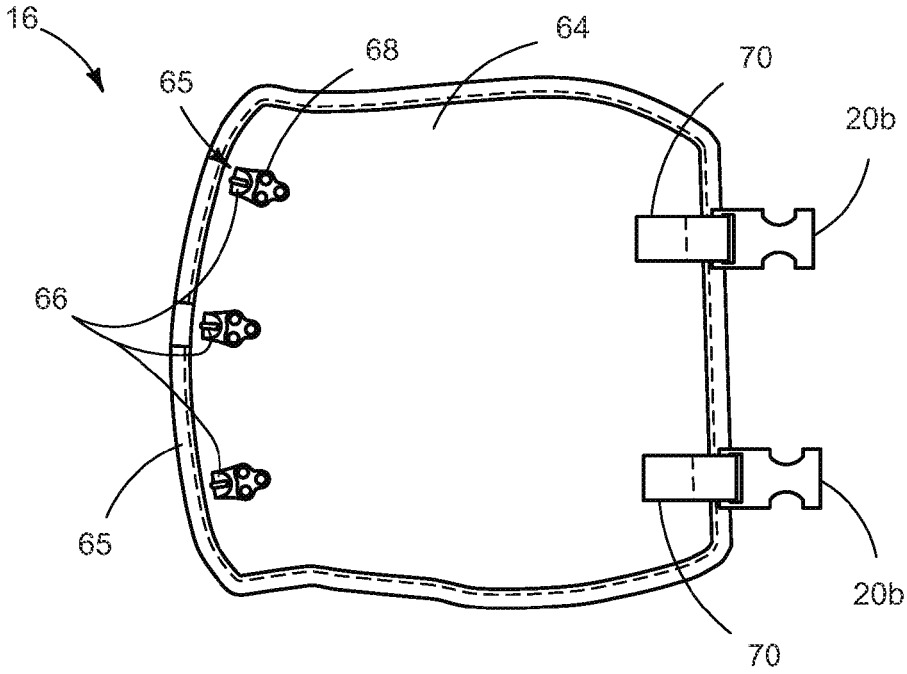
FIG. 7 is a bottom view of the cover of FIG. 6.

FIG. 6 is a top view and FIG. 7 is a bottom view of the cover 16 in accordance with one embodiment of the present invention. As shown in FIG. 6, the cover 16 can be configured with decorative or distinctive markings 62 on an outer surface 63. Distinctive markings 62 can include shapes and colors integrated into a design, indicia, identification information, etc. The outer surface 63 of the cover 16 can also include utility features (not shown) such as handles, pockets, straps, water bottle holders, integrated light systems, speaker systems, etc. In the illustrated embodiment, the cover 16 is in the shape of a flap and made of a flexible material that allows the cover 16 to bend and fold. The cover 16 can also be contoured to correspond to the contours of the body 14 and provide a better fit or seal for the open end 24 when engaged in a closed position (as shown in FIG. 1). In another embodiment, the cover 16 can be formed of a substantially rigid or stiff material that has been molded to fit over the open end 24 of the body 14. In another embodiment, a first portion of the cover can be substantially rigid or stiff, and another portion can be flexible.

As shown in FIG. 7, an inner surface 64 of the cover 16 has a positive engagement mechanism 65 for releaseably coupling the cover 16 to the body 14 to form the interchangeable bag and cover assembly 12. As illustrated, the engagement mechanism 65 can be a plurality of clips 66 attached to the inner surface 64 and configured to positively engage the integrated rods 50 on the body 14. Other positive engagement mechanisms 65 can include snap rings, locking rings, straps, etc. The clips 66 can be attached to the inner surface 64 with a plurality of rivets 68. In one embodiment, three rivets 68 are used to secure each clip 66 to the cover 16 and prevent rotation or other movement of the clip 66 with respect to the cover 16. However, one of ordinary skill in the art will recognize that one or more rivets 68 can be used in various configurations. Additionally, the clips 66 can be attached with snaps, screws, thread, adhesive, or other positive attachment mechanisms.

The cover 16 can also include second closure attachment sites 70 for integrating a corresponding half 20*b* of the mating closure 20 (e.g. the male or female portion of a buckle, a magnet, a snap, a button, a hook or loop strip, etc.) for mating with the first half 20*a* attached to the body 14.

Figure 8:
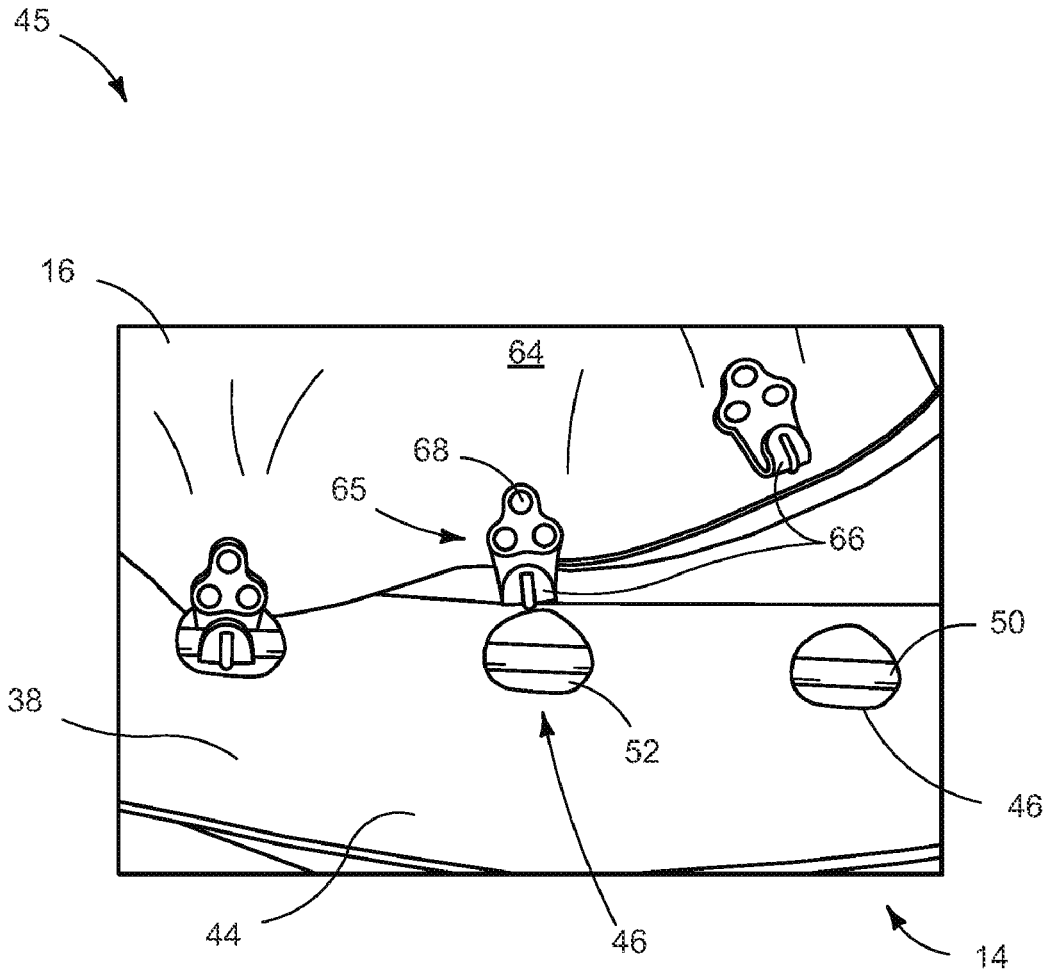
FIG. 8 is an enlarged view of an embodiment of a attachment system illustrating a cover partially attached to a vessel.
Figure 9:
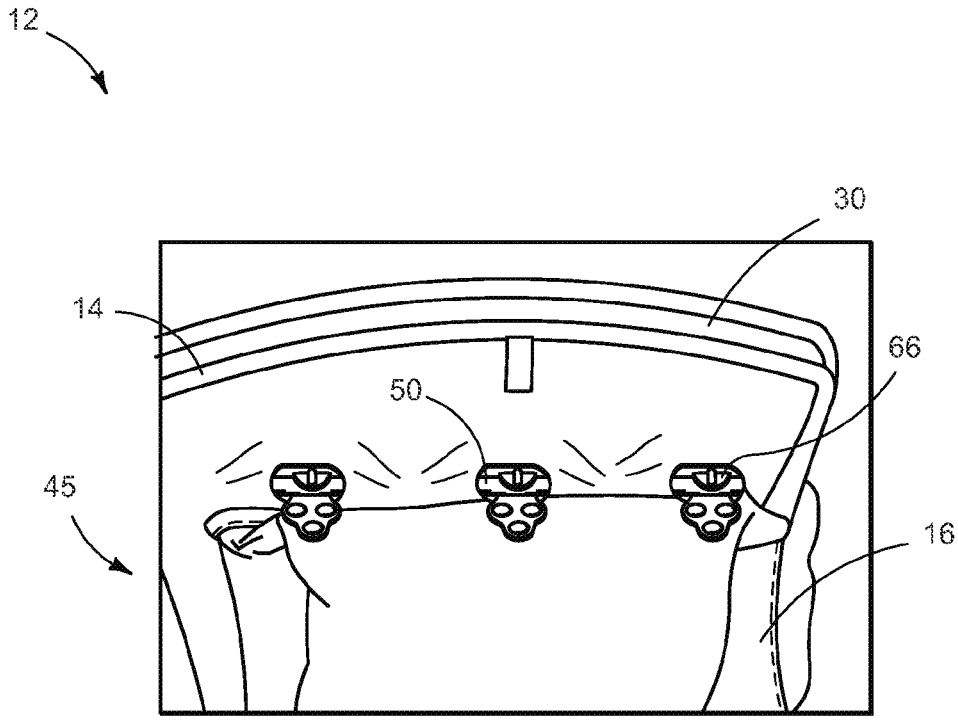
FIG. 9 is an enlarged view of the attachment system of FIG. 8 illustrating a plurality of clips positively engaged on a rod.
Figure 10:
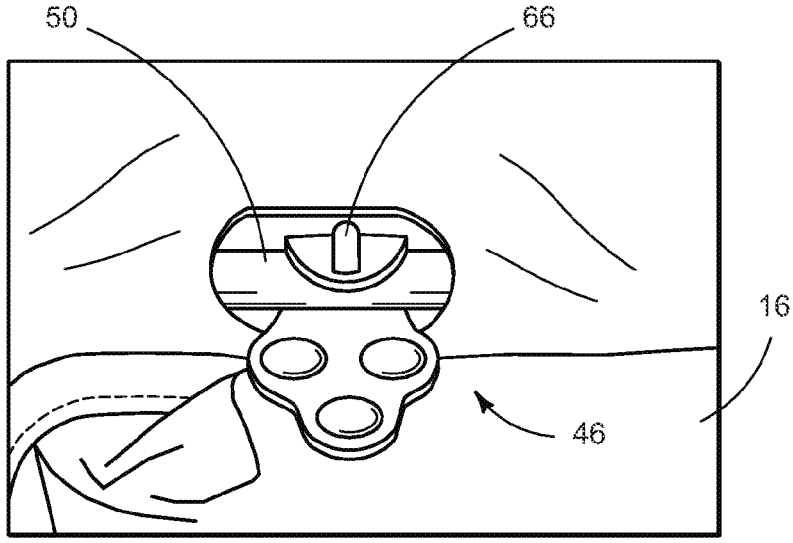
FIG. 10 is an enlarged view of a single clip engaged on a rod.

FIG. 8 is an enlarged view of one embodiment of the attachment system 45 illustrating the cover 16 partially attached to the body 14. The cover 16 can be removeably attached to the body 14 by positively engaging the clips 66 onto the rod 50 at the attachment portion 46. As illustrated, the clips 66 can engage the rod 50 through access portals 52 in the exterior surface 38 of the back panel 44. Each clip 66 can independently engage the rod 50 at the corresponding attachment portion 46 to align and attach the cover 16 to the body 14. FIG. 9 illustrates a fully-attached cover 16 having the plurality of clips 66 engaging the rod 50 of the corresponding body 14. FIG. 10 is an enlarged view of a single clip 66 positively engaging the rod 50 at an attachment portion 46. Independently engaged and separated clips 66 provide flexibility to the attachment system 45 and supports proper alignment of the cover 16 with respect to the open end 24 of the body 14. The clips 66 can be attached and detached from the rod 50 when the cover 16 is in an open position. Referring back to FIG. 2, the attachment system 45 can be concealed when the cover 16 overlaps the open end 24 of the body 14 in a closed position.

Figure 11:
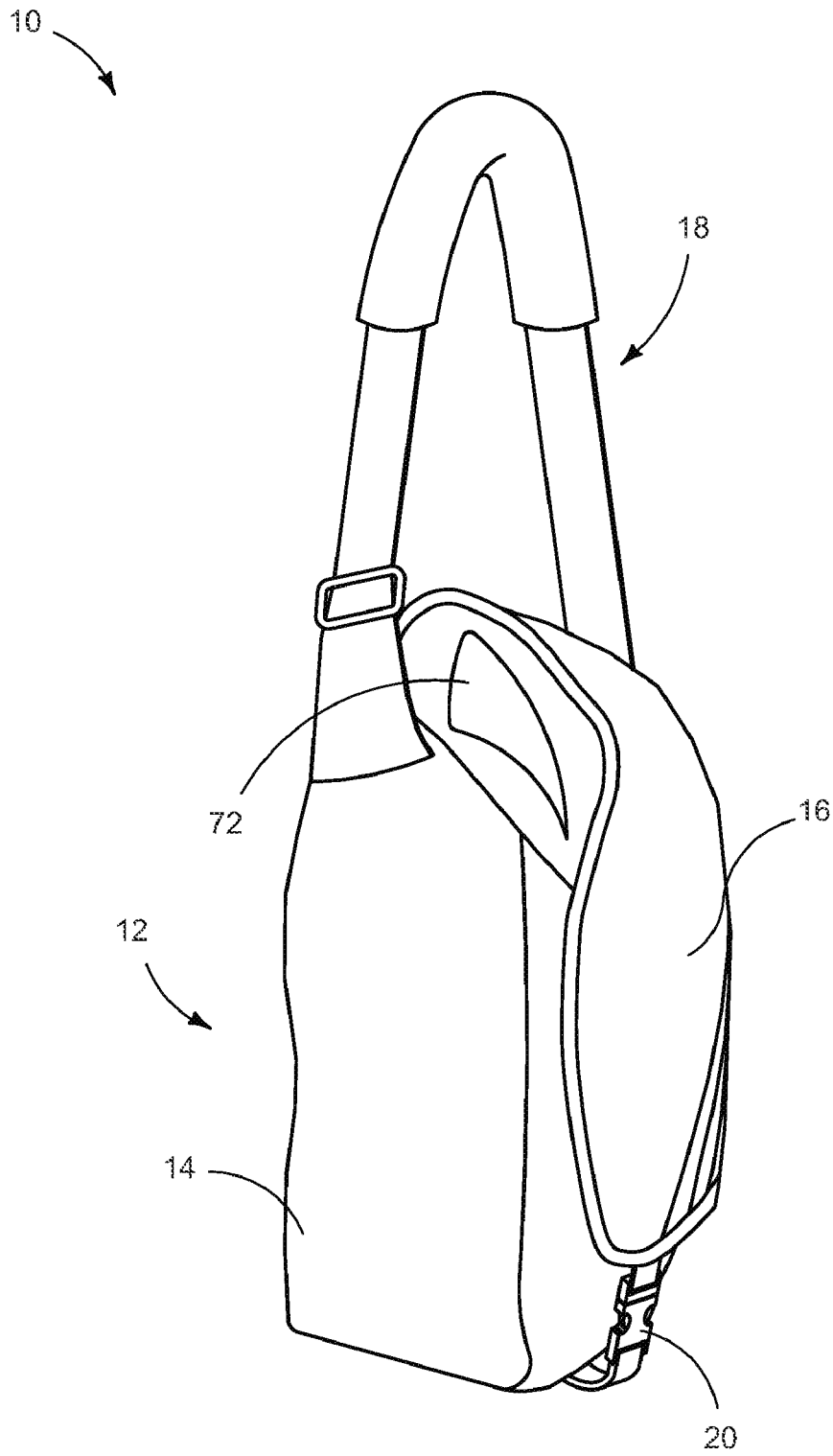
FIG. 11 is a side view of the convertible bag system of FIG. 1.

Following engagement with the rod 50, the clips 66 can be configured to rotate around the rod 50 while maintaining secure attachment. In this embodiment, the cover 16 can be easily rotated about the rod 50 to provide access to the cavity 30 when in an open position, and rotated about the rod 50 to conform to the contours of the body 14 when in a closed position. FIG. 11 is a side perspective view of the convertible bag system 10 of FIG. 1 following cover 16 attachment and rotation to overlap the open end 24 of the body 14. The plurality of mating-type closures 20 (e.g. belt buckles, squeeze lock buckles, buttons, snaps, corresponding hook and loop strips, corresponding magnets, etc.) can be engaged for securing the cover 16 in the closed position. Gussets 72 can be incorporated on the sides 74 of the cover 16 to reinforce the cover 16 while in a closed position and to prevent items from falling out of the cavity 30. Additionally, gussets 72 can prevent moisture, debris, etc. from penetrating the interior cavity 30. The gussets 72 may be formed from the same material as the cover 16 or from different material. In some embodiments, the gussets 72 may be elastic and allow stretching while manipulating the cover 16 from a closed position to an open position. In other embodiments, the gussets 72 can be removeably attached such that the gussets may be removed from the cover 16 when unnecessary or undesirable.

Referring back to FIG. 1, and as described above, the integrated strap system 18 can incorporate several features, such as the length adjustment mechanism 19, shoulder padding 76, and releasable attachment sites (not shown). The strap system 18 can incorporate one or more straps 78 arranged to be worn on one or more shoulders or other parts of the body. For example, a single strap 78 can be provided to be worn on or over a shoulder of a user. In another embodiment, two independent straps 78 can be provided to be worn over both shoulders such that the convertible bag system 10 operates as a backpack.

The convertible bag system 10 can be configured for use as a messenger bag, backpack, purse, pannier, briefcase, suitcase, saddlebag, etc. Furthermore, the convertible bag system 10 can be configured to have the appearance altered by interchanging or swapping one cover 16 attached to a body 14 for a second cover 16. Moreover, the function of the convertible bag system 10 can be alterable when the body 14 or strap system 18 is replaced or reconfigured. For example, the integrated strap system 18 can be interchangeable, such that a single messenger bag strap 78 is replaced with two attachable straps 78 configured to be worn in the style of a backpack.

The body 14 and the cover 16 can be formed using a variety of materials, such as leather, fabric, vinyl, mesh, canvas, hard or soft plastic, nylon, or other selected materials or combination of materials, etc. Furthermore, the material may include other beneficial features, such as being waterproof, tear proof, light reflective (e.g. for use at night), washable, breathable, clear, colorful, etc. The material used to form the body 14 can be the same or different from the material used to form the cover 16. For example, the body 14 can be made of a sturdy, durable fabric while a multiple of different types of covers 16 can be removeably attached in an occasion-dependent manner. For example, a water proof cover can be attached when raining, a leather cover for formal occasions, a cover with multiple pockets for traveling, a hard cover for protecting fragile interior contents, etc.

From the foregoing, it will be appreciated that specific embodiments of the invention have been described herein for purposes of illustration, but that various modifications may be made without deviating from the spirit and scope of the invention. Accordingly, the invention is not limited except as by the appended claims.

We claim:

1. A convertible bag system, comprising:

a bag body having side portions that define an interior area having an opening, the body having a cover-connection portion;

a first securing mechanism coupled to the body, the first securing mechanism including a substantially rigid rod; and a plurality of covers interchangeably connectable to the body, each cover having a body-connection portion releasably attachable to the cover-connection portion of the body, wherein the cover is moveable relative to the body between an open position and a closed position, each cover having a free end portion positionable adjacent to the body when the cover is in the closed position, each cover having a second securing mechanism configured to releasably engage the first securing mechanism to retain the cover in the closed position, wherein the second securing mechanism includes at least one clip that releasably engages the substantially rigid rod where the substantially rigid rod and the at least one clip are obscured from view when the cover is in the closed position.

2. The convertible bag system of claim 1 wherein at least one of the plurality of covers includes side gusset portions positioned adjacent to the opening when the cover is attached to the body and configured to provide a barrier that blocks access to side portions of the opening.

3. The convertible bag system of claim 1 wherein the body is a first body and further comprising a plurality of body portions each having a cover-connection portion interchangeably, releasably attachable to each of the plurality of covers wherein any of the covers can be used with any of the bodies and being movable between the open and closed positions.

4. The convertible bag system of claim 1 wherein the substantially rigid rod is anchored to at least one of the side portions of the body.

5. The convertible bag system of claim 1 wherein the cover-connection portion of the body includes a plurality of rods, and the body-connection portion of at least one cover includes a plurality of mating connectors releasably coupleable with the plurality of rods.

6. The convertible bag system of claim 1 wherein the body-connection portion of at least one cover includes a plurality of connectors that releasably mate with the cover-connection portion of the body and pivot about the cover-connection portion between the open position and closed position.

7. The convertible bag system of claim 1 wherein the body includes at least one of a carrying handle and a shoulder strap.

8. The convertible bag system of claim 1 wherein the cover-connection portion is at least partially contained in one of the side portions of the body, and the one of the side portions has at least one access aperture configured to allow the body-connection portion to access and attach to the cover-connection portion.

9. The convertible bag system of claim 1 wherein the body and at least one of the plurality of covers form a messenger bag.

10. The convertible bag system of claim 1 wherein at least one of the plurality of covers has a first surface that faces the body when the cover is in the closed position, and a second surface that faces away from the body when the cover is in the closed position, the body-connection portion is positioned adjacent to the first surface, wherein the body-connection portion and the cover-connection portion are covered and obscured from view when the cover is in the closed position.

11. The convertible bag system of claim 1 wherein the cover-connection portion of the body and the body-connection portion of at least one of the plurality of covers are obscured from view when the cover is in the closed position.

12. The convertible bag system of claim 1 wherein at least one of the plurality of covers is a flexible flap cover having a first pattern and color, and another one of the plurality of covers has a second pattern and color different from the first pattern and color.

13. An interchangeable bag and cover system, comprising:

a plurality of bag bodies, each body having a plurality of panels that define a closed end, an open end, and a cavity configured to contain selected items inserted therein through the opening, each body having a first connector, the first connector including a substantially rigid rod; and a plurality of covers interchangeably and releasably connectable to any of the bodies, each cover, when connected to a selected body being moveable relative to the selected body between an open position and a closed position, each cover configured to extend across the open end when in the closed position and to expose the open end when in the open position, each cover having a second connector releasably engageable with any of the first connectors of any of the bodies, so that any of the covers can be interchangeably used with any of the bodies, wherein the second connector includes at least one clip that releasably engages the substantially rigid rod such that the substantially rigid rod and the at least one clip are obscured from view when the cover is in the closed position.

14. The system of claim 13 wherein each body has a first closure device, and each cover has a second closure device that releasably mates with the first closure device to hold the cover in the closed position, and the second closure device being separated from the first closure device when the cover is in the open position.

15. The system of claim 14 wherein at least one of the plurality of covers includes side gusset portions positioned adjacent to the open end the selected body when the cover is attached to the selected body providing a barrier that blocks access to side portions of the opening.

16. The system of claim 13 wherein the at least one clip and the substantially rigid rod are configured to allow the plurality of covers to pivot about the substantially rigid rod for movement between the open and closed positions.

17. The system of claim 13 wherein at least one of the plurality of bodies includes at least one of a carrying handle and a shoulder strap.

18. The system of claim 13 wherein at least one of the plurality of bodies includes at least one of an internal pocket, an external pocket, and a removable pocket.

19. A convertible bag and cover assembly, comprising:

a bag body having a closed end, an open end, and a cavity configured to contain selected items inserted therein through an opening, the body having a first connector, the first connector including a substantially rigid rod; and a cover releasably connected to the body, the cover, when connected to the body, being moveable relative to the body between open and closed positions, the cover configured to extend across the open end when in the closed position and to expose the open end when in the open position, the cover having a second connector releasably engageable with the first connector of the body, so that the cover can be removed and interchangeably replaced by another cover having substantially the same construction as said cover, wherein the second connector includes at least one clip that releasably engages the substantially rigid rod such that the substantially rigid rod and the at least one clip are obscured from view when the cover is in the closed position.

20. The assembly of claim 19 wherein the cover includes side gusset portions positioned adjacent to the opening when the cover is attached to the body and configured to provide a barrier that blocks access to side portions of the opening.

21. The assembly of claim 19 wherein the body has a first closure device, and the cover has a second closure device that releasably mates with the first closure device to hold the cover in the closed position, and the second closure device being separated from the first closure device when the cover is in the open position.

22. The assembly of claim 19 wherein the at least one clip and the substantially rigid rod are configured to allow the cover to pivot about the substantially rigid rod for movement between the open and closed positions.

23. The assembly of claim 19 wherein the body includes at least one of an internal pocket, an external pocket, and a removable pocket.

* * * * *